US010233858B2

(12) United States Patent
Radeczky et al.

(10) Patent No.: US 10,233,858 B2
(45) Date of Patent: Mar. 19, 2019

(54) METHOD AND DEVICE FOR DETERMINING THE MINIMUM HYDRAULIC INJECTION INTERVAL OF A PIEZO-SERVO INJECTOR

(71) Applicant: Continental Automotive GmbH, Hannover (DE)

(72) Inventors: Janos Radeczky, Wenzenbach (DE); Christian Bauer, Treffelstein (DE); Janos Kerekgyarto, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/736,218

(22) PCT Filed: Jun. 13, 2016

(86) PCT No.: PCT/EP2016/063522
§ 371 (c)(1),
(2) Date: Dec. 13, 2017

(87) PCT Pub. No.: WO2017/001180
PCT Pub. Date: Jan. 5, 2017

(65) Prior Publication Data

US 2018/0179980 A1 Jun. 28, 2018

(30) Foreign Application Priority Data

Jun. 29, 2015 (DE) ..... 10 2015 212 085

(51) Int. Cl.
*F02D 41/24* (2006.01)
*F02D 41/20* (2006.01)
*F02D 41/30* (2006.01)

(52) U.S. Cl.
CPC ..... *F02D 41/247* (2013.01); *F02D 41/2096* (2013.01); *F02D 41/2467* (2013.01); *F02D 41/30* (2013.01); *F02D 2041/2055* (2013.01)

(58) Field of Classification Search
CPC ..... F02D 41/2096; F02D 41/2467; F02D 41/247; F02D 2041/2055
(Continued)

(56) References Cited

U.S. PATENT DOCUMENTS 6,192,855 B1 * 2/2001 Schietecatte ..... F02D 41/1497 123/299
7,152,575 B2 * 12/2006 Fritsch ..... F02D 41/2422 123/299
(Continued)

FOREIGN PATENT DOCUMENTS

DE 102005030132 A1 1/2007
DE 102006033932 A1 2/2008
(Continued)

OTHER PUBLICATIONS

International Search Report and Written Opinion dated Aug. 11, 2016 from corresponding International Patent Application No. PCT/EP2016/063522.
(Continued)

*Primary Examiner* — Erick Solis

(57) ABSTRACT

A method and a device for determining the minimum hydraulic injection interval of a piezo-servo injector are described. The closing time of the nozzle needle of the injector is determined on the basis of the characteristic pressure profile in the control spring chamber of the injector. By incrementally reducing the injection interval of a subsequent injection by successively advancing the timing of the start of actuation of a subsequent injection and continuing to observe the pressure profile in the control spring chamber, the smallest injection interval is obtained from the
(Continued)

Figure 1:
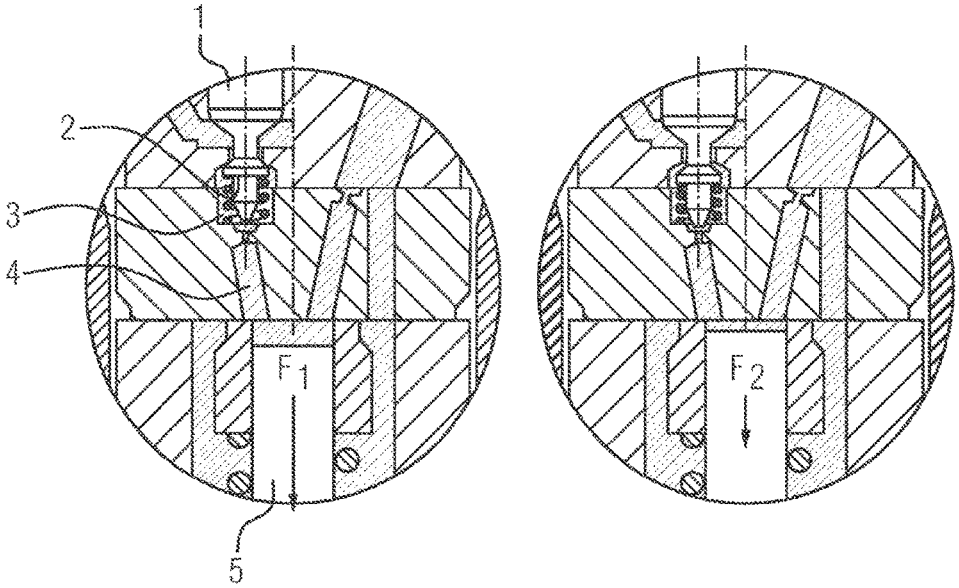

last iteration step in which closing of the nozzle needle of the preceding injection could still be detected in the characteristic pressure profile. Particularly precise determination of the minimum injection interval is possible with this method.

8 Claims, 1 Drawing Sheet

(58) Field of Classification Search
USPC ..... 701/105; 123/299, 472
See application file for complete search history.

(56) References Cited

U.S. PATENT DOCUMENTS

| | | | | |
|---|---|---|---|---|
| 9,541,021 | B2 * | 1/2017 | Baqasse | F02D 41/221 |
| 2008/0017173 | A1 * | 1/2008 | Fujii | F02D 41/1497 123/478 |
| 2013/0074806 | A1 | 3/2013 | Casalone et al. | |
| 2015/0226148 | A1 * | 8/2015 | Beer | F02D 41/247 123/480 |
| 2016/0115896 | A1 * | 4/2016 | Kanbara | F02D 41/403 123/478 |
| 2017/0074197 | A1 * | 3/2017 | Radeczky | F02D 41/2096 |

FOREIGN PATENT DOCUMENTS

| | | | |
|---|---|---|---|
| DE | 102007000394 | A1 | 2/2008 |
| DE | 102008023373 | A1 | 4/2010 |
| DE | 102013223764 | B3 | 2/2015 |
| DE | 102012213883 | A1 | 3/2015 |
| EP | 2453124 | A1 | 5/2012 |
| WO | 01/63121 | A1 | 8/2001 |
| WO | 2015/074794 | A1 | 5/2015 |

OTHER PUBLICATIONS

Search Report dated Jan. 12, 2016 for corresponding German Patent Application No. 10 2015 212 085.6.

Notice to Submit Response, dated Oct. 25, 2018, Korean Intellectual Property Office, for counterpart KR patent application 10-2017-7035716.

* cited by examiner

METHOD AND DEVICE FOR DETERMINING THE MINIMUM HYDRAULIC INJECTION INTERVAL OF A PIEZO-SERVO INJECTOR

The present invention relates to a method for determining the minimum hydraulic injection interval of a piezo-servo injector.

Successive injections of an injector influence one another mutually, in particular when there is a small timing interval. If there is a desire to implement the smallest possible injection intervals, the actuator of an injector with a servo valve must already be loaded for a subsequent pulse before the nozzle needle of the previous pulse is closed again.

Merging of two successive injections can be prevented by conservative, reliable calibration of the smallest hydraulic injection interval. However, such a safeguard is not optimum, since it results in potential for shorter dwell times (injection-free times) being unnecessarily lost. Furthermore, there is the risk here that despite separate actuation pulses there can still be fusing of two injection rates in one individual injection.

In order to be able to meet the ever stricter requirements in terms of minimum implementable injection intervals, new concepts are necessary which detect and compensate the variation of components and aging effects.

The invention is based on the object of providing a method of the type described at the beginning which permits particularly precise determination of the minimum hydraulic injection interval.

This object is achieved according to the invention by means of a method of the specified type which comprises the following steps:

determining the closing time of the nozzle needle of the injector on the basis of the characteristic pressure profile in the control spring chamber of the injector;

incrementally reducing the injection interval of a subsequent injection by successively advancing the timing of the start of actuation of a subsequent injection and at the same time continuing to observe the pressure profile in the control spring chamber; and obtaining the smallest injection interval from the last iteration step in which closing of the nozzle needle of the preceding injection could still be detected in the characteristic pressure profile.

The method according to the invention relates to a piezo-servo injector in which a piezo actuator is lengthened by applying a voltage and as a result acts on a control valve (servo valve) which controls a nozzle needle to inject fuel. In particular, the piezo actuator acts on a control piston which opens a control spring chamber via which the nozzle needle is acted on. In the opposite direction, a spring which is arranged in the control spring chamber brings about closing of the control spring chamber.

In the method according to the invention, the closing time of the nozzle needle of the injector will now be determined on the basis of the characteristic pressure profile in the control spring chamber of the injector. During the closing movement of the nozzle needle, in fact a detectable reduction in pressure in the control spring chamber occurs which is caused by accelerating the nozzle needle just before the impacting on the needle seat. At the moment of the closing or braking of the nozzle needle in the seat, a pressure peak is generated in the control spring chamber.

These characteristic points are detected according to the invention and the closing time of the nozzle needle is determined therefrom.

In a further step of the method according to the invention, the injection interval of a subsequent injection is incrementally reduced by successively advancing the timing of the start of actuation of a subsequent injection. In this context, the pressure profile in the control spring chamber is observed further. The smallest injection interval is acquired from the last iteration step in which closing of the nozzle needle of the preceding injection could still be detected in the characteristic pressure profile.

According to the invention, the smallest hydraulic injection interval is therefore determined by detecting physical profiles (pressure in the control spring chamber) in the region of the closing of the needle. As a result, the consequences of different aging effects (idle stroke changes, changes in the needle seat geometry) which are relevant for the closing time of the needle can be taken into account. On the one hand, in this way the smallest dwell times can be calibrated. On the other hand, the system performance can be ensured over the service life of the injector.

By means of the determination of the minimum hydraulic injection interval (i.e. of the minimum interval between two injection processes which is possible without the two injections influencing one another) which is carried out according to the invention, it is possible, for example, to carry out corresponding adaptations with respect to variations of components and aging effects. In this way, for example the smallest injection interval which is obtained can be used as the basis for subsequent multiple injections.

In one development of the method according to the invention, the pressure profile in the control spring chamber is measured by means of the piezo actuator according to a known signal evaluation. This can be carried out, for example, in a way as described in DE 10 2008 023 373 A1. According to this concept, the profile of the piezo force is described on the basis of piezo modeling. The position of the maximum of this profile describes the chronological servo valve opening, wherein this absolute value correlates with the force which is necessary for the valve opening. As a result the abovementioned characteristic pressure profile in the control spring chamber can be reflected in the region of the minimum hydraulic injection intervals by means of this information.

The method according to the invention can be carried out within the scope of calibration of the injector. It is therefore possible for the method to be carried out as a part of a process of measuring the injector in a measurement setup. The method according to the invention can, however, also be carried out during the operation of an associated internal combustion engine by dynamically adjusting a normal subsequent injection. In this way, for example a min-dwell control process can be implemented, i.e. control in order to obtain a minimum interval between two injection processes without mutual influencing of the two processes.

In particular, in this context the minimum injection interval can be determined during ongoing operation of the injector without an adaptation pulse. In this context, the position of a normal injection, which is to be emitted as close as possible, that is to say with the smallest injection interval, is changed dynamically. The physical relationships which are described above are then evaluated during the energization phase of the piezo actuator.

The method according to the invention can also be carried out within the scope of an adaptation run. The operation is then carried out with the adapted values until the next adaptation run, which is recurrently carried out in each case after a specific operating time (for example every 1000 km) or at specific operating points, for example whenever a vehicle starts.

The present invention also relates to a device which is designed to carry out the method described above.

The term "control spring chamber" used here is intended to comprise a single space for acting on the nozzle needle, which space can be opened and closed with a control valve element (servo valve element) and has a spring arranged in it, and a spring chamber in which the control valve element and spring are arranged, and a downstream control chamber for acting on the nozzle needle.

Figure 2:
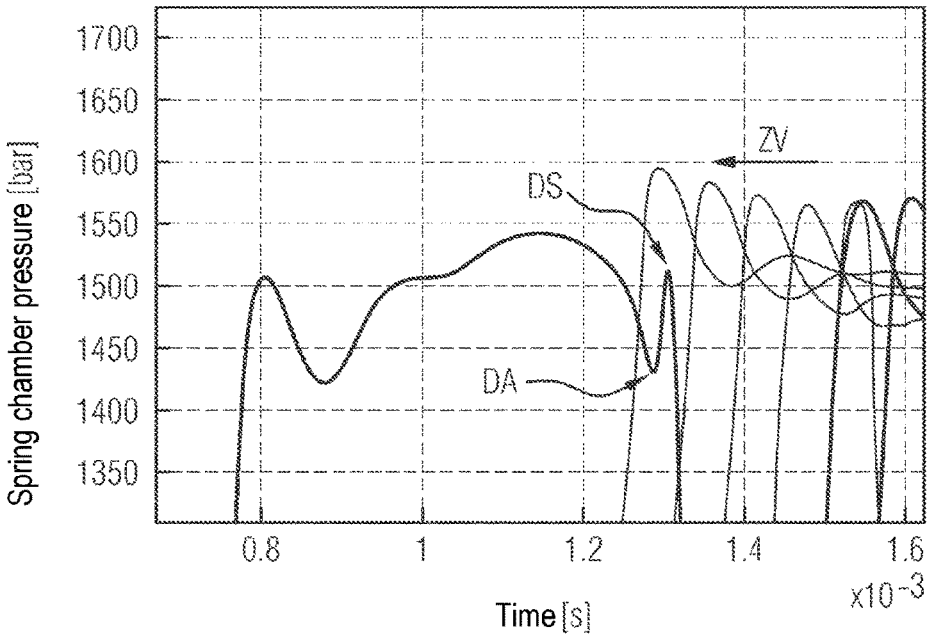

The invention is explained in detail below on the basis of an exemplary embodiment and in conjunction with the drawing, in which:

FIG. 1 shows a detail of an injector, wherein the injector is illustrated in a closed state on the left and the injector is illustrated in an opened state on the right; and FIG. 2 shows a diagram which shows the spring chamber pressure profile.

FIG. 1 shows a detail of an injector with which the method according to the invention for determining the minimum hydraulic injection interval is carried out. This is a piezo-servo injector which has a piezo-actuator (not illustrated) which acts on a control piston 1 of a control valve 2 or servo valve. The control valve 2 opens and closes a spring chamber 3 by means of a movement of the control piston 1 which is brought about by lengthening and contraction of the piezo actuator, in which spring chamber 3 a spring is located which acts on the control valve 2 in the opposite direction. Arranged downstream of the spring chamber 3 is a control chamber 4 via which pressure is applied to a nozzle needle 5, in order to carry out a corresponding injection process.

The left-hand illustration in FIG. 1 shows the injector in the closed state in which no injection takes place and the control valve is closed, while the right-hand illustration shows the injector in the open state with the control valve open, with an injection being carried out.

In the method according to the invention, the closing time of the nozzle needle 5 of the injector will now be determined on the basis of the characteristic pressure profile in the control spring chamber of the injector, with the spring chamber pressure profile being detected in this exemplary embodiment.

FIG. 2 shows a diagram of the spring chamber pressure profile plotted against the time. It is apparent that during the closing movement of the nozzle needle a detectable pressure reduction DA occurs in the spring chamber, which pressure reduction DA is caused by acceleration of the nozzle needle just before the impacting on the needle seat. At the moment of the closing or braking of the nozzle needle in the seat, a pressure peak DS is generated in the spring chamber.

Corresponding characteristic points are detected according to the invention, and the closing time of the nozzle needle is determined therefrom.

In a further step, the injection interval of a subsequent injection is incrementally reduced by successively advancing ZV the timing of the start of actuation of a subsequent injection.

In this context, the pressure profile in the spring chamber is observed further. The smallest injection interval is acquired from the last iteration step in which closing of the nozzle needle of the preceding injection could still be detected in the characteristic pressure profile.

The invention claimed is:

1. A method for determining minimum hydraulic injection interval of a piezo-servo injector, comprising the steps of:

determining a closing time of a nozzle needle of the injector on the basis of a characteristic pressure profile in a control spring chamber of the injector;

incrementally reducing the injection interval of a subsequent injection by successively advancing timing of a start of actuation of the subsequent injection and at the same time continuing to observe the pressure profile in the control spring chamber; and obtaining a smallest injection interval from last iteration step in which closing of the nozzle needle of the preceding injection could still be detected in the characteristic pressure profile.

2. The method as claimed in claim 1, wherein the smallest injection interval which is obtained is used as the basis for subsequent multiple injections.

3. The method as claimed in claim 1, wherein the pressure profile in the control spring chamber is measured by a piezo actuator according to known signal evaluation.

4. The method as claimed in claim 1, wherein said method is carried out during calibration of the injector.

5. The method as claimed in claim 4, wherein said method is comprised in a process of measuring the injector in a measurement setup.

6. The method as claimed in claim 1, wherein said method is carried out during operation of an associated internal combustion engine and comprises dynamically adjusting a normal subsequent injection.

7. The method as claimed in claim 1, wherein said method is comprised in a min-dwell control process.

8. A device configured to carry out the method as claimed in claim 1.

* * * * *